United States Patent [19]

Stoll

[11] 4,348,942

[45] Sep. 14, 1982

[54] PRESSURE-MEDIUM CONNECTION BETWEEN A VALVE BLOCK AND A LOAD WHICH HAS AT LEAST ONE DOUBLE-ACTING PRESSURE-MEDIUM MOTOR

[76] Inventor: Kurt Stoll, Lenzhalde 72, 7300 Esslingen, Neckar, Fed. Rep. of Germany

[21] Appl. No.: 179,602

[22] Filed: Aug. 19, 1980

[30] Foreign Application Priority Data

Aug. 21, 1979 [DE] Fed. Rep. of Germany ..... 2933704

[51] Int. Cl.[3] ..... F15B 13/00

[52] U.S. Cl. ..... 91/54; 92/59; 137/270; 137/884

[58] Field of Search ..... 91/30, 54; 92/59; 137/270, 884

[56] References Cited

U.S. PATENT DOCUMENTS

| | | | |
|---|---|---|---|
| 1,752,631 | 4/1930 | Campbell | 137/270 |
| 2,932,284 | 4/1960 | Stace | 92/59 |
| 3,357,444 | 12/1967 | Zeuner | 137/270 |
| 3,602,246 | 8/1971 | Hettinger | 137/270 |
| 4,027,692 | 6/1977 | Bouteille | 137/270 |

*Primary Examiner*—Robert G. Nilson

*Attorney, Agent, or Firm*—Blanchard, Flynn, Thiel, Boutell & Tanis

[57] ABSTRACT

A pressure-medium connection between a valve block and a load which has at least one double-acting pressure-medium motor. The valve block and load each have two connecting openings for supplying the pressure-medium motor. An interposed sealing plate has through openings in the form of channels which extend in the plane of such sealing plate for connecting the resepctive openings of the valve block housing and load housing. The connecting openings of the valve block housing are offset with respect to the connecting openings of the load housing. In a first operating position of the sealing plate, the control channels therein connect the first connecting openings of the valve block housing and load housing and also connect the second connecting openings of the valve block housing and load housing. In a second operating position of the sealing plate, the control channels therein connect the first connecting opening of the valve block housing to the second connecting opening of the load housing and connect the second connecting opening of the valve block housing to the first connecting opening of the load housing.

6 Claims, 7 Drawing Figures

22
16
40
42
36
34
32
8
30
44
38
IIA
IIB
IIC
16
29
16
6
18
14
10
12
20
16
14
24
28
26

PRESSURE-MEDIUM CONNECTION BETWEEN A VALVE BLOCK AND A LOAD WHICH HAS AT LEAST ONE DOUBLE-ACTING PRESSURE-MEDIUM MOTOR

FIELD OF THE INVENTION

The invention relates to a pressure-medium connection between a valve block and a load which has at least one double-acting pressure-medium motor, wherein two connecting openings are provided in each of the value block housing and load housing for supplying of pressure-medium to the motor.

BACKGROUND OF THE INVENTION

Such pressure-medium connections with sealing plates are used when one wants to fasten a valve block directly on a load. In this manner there are no pressure-medium hoses at all between the valve block and the load which, in view of the moved parts of the load, improves operating safety and furthermore permits a compact design of the valve block-load unit. On the other hand, connection of valve block and load through pressure-medium hoses interposed therebetween has the advantage that, with the same control of the valves of the valve block from a fluidic or electronic program control, a reversal of movement can be achieved by a simple changing of the pressure-medium hoses; the control programs do not need to be changed for this, and also no changes need to be made in the valves themselves.

A purpose of the present invention is to provide a pressure-medium connection of the type including a sealing plate wherein a movement reversal is obtained in a simple manner and without changing the control of the valve block.

The inventive pressure-medium connection unites the advantages of a sealing plate pressure-medium connection (compact structure, freedom of breakdown) with the flexibility of a pressure-medium connection which has pressure-medium hoses. No addition of apparatus is thereby needed compared with the above-mentioned prior art devices.

BRIEF DESCRIPTION OF THE DRAWINGS

The invention will be discussed in greater detail hereinafter in connection with exemplary embodiments and with reference to the enclosed drawings, in which.

DETAILED DESCRIPTION

Figure 1:
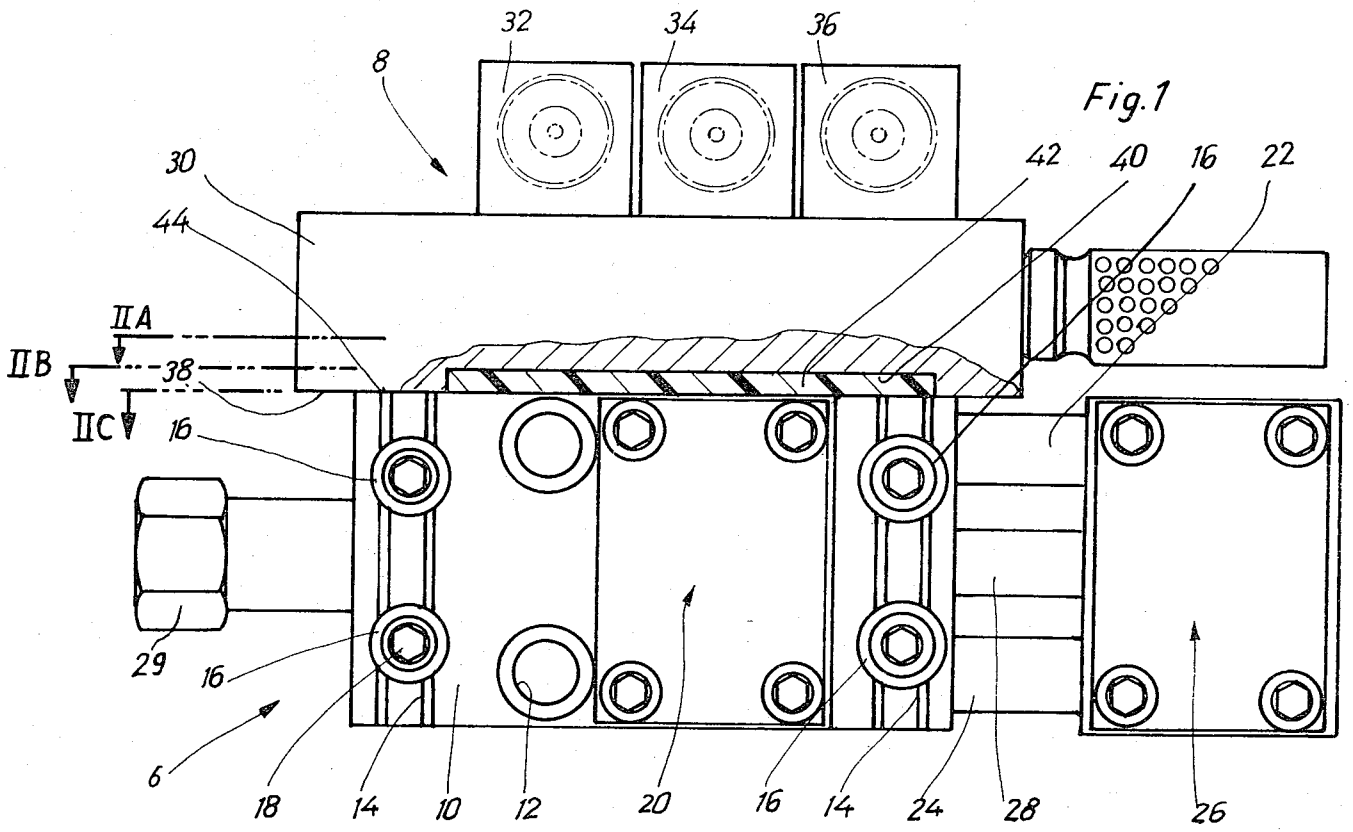
FIG. 1 is a top view of a tape-feed device with attached valve block.

FIG. 1 illustrates a tape-feed device 6, on which is screwed a valve block 8. Such a tape-feed device may be used for intermittent movement of tape material (not shown) to a punch press (not shown), or to a different machine which also processes the tape material intermittently.

The tape-feed device 16 has a housing 10 with through openings 12 for receiving fastening bolts (not shown), through which it is connected, for example, to the above-mentioned punch press. Two guide rollers 16 for the lateral edges of the tape material are each secured for lateral adjustability by clamping bolts 18 in transverse grooves of the housing 10. The housing 10 carries furthermore a first clamp 20. The clamp 20 includes a clamping motor which is loaded with compressed air and is not illustrated in detail, and which clamping motor works on a clamping plate (not shown) which can be shifted perpendicularly to the drawing plane and engages the underside of the tape material.

The housing 10 carries two guide columns 22, 24, on which a second clamp 26 is movable. The second clamp 26 also has a clamping motor which is loaded with compressed air and a clamping plate (not shown) which can be shifted perpendicularly to the drawing plane. The loading with compressed air and ventilation of said second clamping motor is done through channels provided in the guide column 22. The second clamp 26 is secured at the end of a piston rod 28, which illustrates the driven part of a compressed-air feed motor 29, which is located in the housing 10 and is double-acting and thus has two working chambers. The feed motor is not shown in detail.

The valve block 8 has a housing 30, which carries a 4/2-valve 32 for controlling the pressure loading of the first clamp 20, a 4/2-valve 34 for controlling the pressure loading of the second clamp 26 and a 4/2-valve 36 for controlling the pressure loading of the feed motor 29. A recess 40 is constructed in the connecting surface 38 of the housing 30, which connecting surface is adjacent to the tape-feed device 6. A sealing plate 42 is fitted positively locking into said recess 40. The sealing plate 42 rests closely on the connecting surface 44 of the housing 10, which surface 44 faces the valve block 8. Openings in the sealing plate 42 interconnect associated connecting openings of the two housings 10 and 30.

The above-described tape-feed device 6 operates substantially so that the two clamps 20 and 26 are loaded in a push-pull arrangement with compressed air to effect a strong gripping of the tape material, and the two working chambers of the feed motor are loaded synchronously with compressed air with the loading of the clamp 20 or of the clamp 26. If, for example, the feed motor working chamber on the left in FIG. 1 is loaded together with the clamp 26 with compressed air, then the tape material is guided intermittently by the stroke of the feed motor from left to right in FIG. 1.

The tape feed device and valve block to the extent above-described may be conventional and have been disclosed to illustrate a possible application of the present invention. Accordingly, it will be recognized that the above-described parts of the tape-feed device 6, such as the clamps 20, 26 with their clamping motors and clamping plates, the double-acting compressed air feed motor 29, with its two working chambers, and the valve block 8 such as the valves 32, 34 and 36, as well as the provision of pressure fluid to passageways in the tape-feed device 6 and valve block 8, may all be conventional and hence require no further description.

Turning now more specifically to the present invention in order to now be able to reverse the conveying direction of the tape material with an unchanged external control of the valves 32, 34 and 36, the arrangement of the connecting openings in the housings 10 and 30 and the arrangement of the openings in the sealing plate 42 are specially chosen so that a movement reversal is obtained through a simple reversal in the orientation of the sealing plate. This will be discussed in greater detail hereinafter in connection with FIGS. 2 and 3.

Figure 2A:
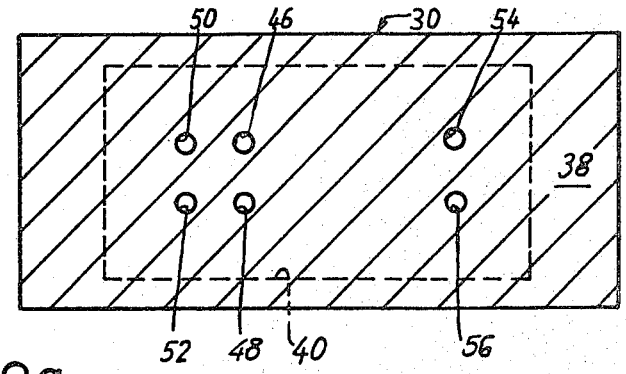
FIG. 2*a* is a top view taken substantially at the level IIA in FIG. 1, of the connecting surface of the valve block, which surface faces the tape-feed device.

FIG. 2*a* shows, in the bottom of the recess 40 in the connecting surface 38, a first connecting opening 46 for pressure loading of the clamping motor of the clamp 20 and a second connecting opening 48 for pressure relief of said clamping motor. A third connecting opening 50 serves the pressure loading of the clamping motor of the clamp 26, a fourth connecting opening 52 for its pressure relief. A fifth connecting opening 54 and a sixth connecting opening 56 serve the selective pressure loading and pressure relief of the two working chambers of the feed motor which operates on the piston rod 28.

Figure 2B:
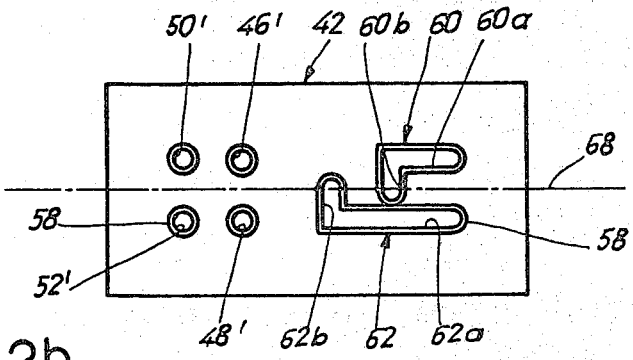
FIG. 2*b* is a top view, taken substantially at the level IIB in FIG. 1, of a sealing plate which is arranged between valve block and tape-feed device.

As can be seen from FIG. 2*b*, the sealing plate 42 has four circular openings 46'–52', which are in alignment with the connecting openings 46 and 52 and are surrounded by sealing beads 58. Furthermore two bent control channels 60 and 62 are constructed in the sealing plate 42, which channels determine flow paths which lie in the sealing-plate plane. The control channels 60 and 62 each have an axial section 60*a* or 62*a* which extends parallel to the longitudinal axis 68 of the sealing plate 42, and a transverse section 60*b* or 62*b* which is attached at a right angle to said axial section. The axial sections 60*a* and 62*a* have their rightward ends in alignment with the connecting opening 54 or 56 when the sealing plate is mounted in the recess 40. The transverse sections 60*b* and 62*b* are axially spaced and their ends are aligned with connecting openings 64 and 66 of the housing 10 when the sealing plate 42 is mounted in the recess 40, connecting openings 64 and 66 in turn are connected to the working chambers of the feed motor. Moreover, the connecting surface 44 of the housing 10 has four connecting openings 46'' to 52'', through which the working chambers of the clamping motors of the clamps can be loaded with or relieved from pressure.

One recognizes from the drawings that the connecting openings 64 and 66 of the housing 10 are in alignment with the longitudinal axis 68 of the sealing plate 42, and also the connecting openings 46 to 56 and 46'' to 52'' and the openings 46' to 52' are arranged in pairs symmetrically with respect to a plane of symmetry defined by the longitudinal axis 68 and perpendicular to the drawing plane. In this way, the entire device for creating a pressure-medium connection between the valve block 8 and the tape-feed device 6, with the exception of the control channels 60 and 62, is symmetrical with respect to said plane of symmetry.

By rotating the sealing plate 42 about its longitudinal axis 68, the connecting openings 54 and 64 as well as 56 and 66, or the connecting openings 54 and 66 as well as 56 and 64, can be connected selectively through the sealing plate 42. The connecting openings 46'' to 52'' are, however, always connected to the respective connecting openings 46 to 52.

Thus, one obtains a control of the clamping motors of the clamps 20 and 26 which control is independent from the orientation of the sealing plate 42. In contrast, one obtains a control of the feed motor which operates on the piston rod 28, which control depends on the orientation of the sealing plate 42. Thus, the conveying direction of the tape-feed device 6 can be preselected by installing the sealing plate 42 in the appropriate orientation for subsequent constant control of the valve block 8.

Figure 2C:
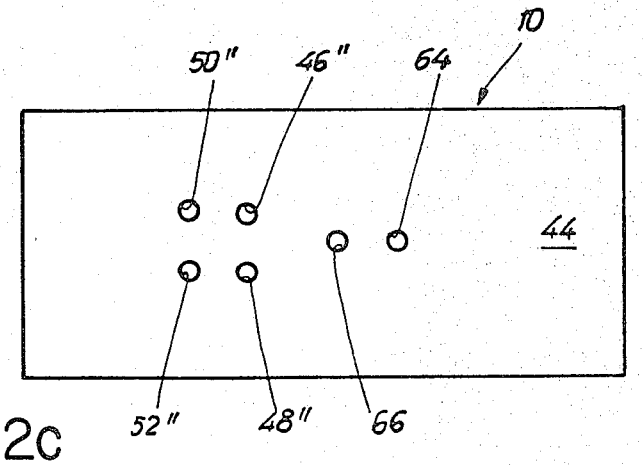
FIG. 2*c* is a top view, taken substantially at the level IIC in FIG. 1, of the connecting surface of the tape-feed device which faces the valve block.

At times it is not possible, or only possible at a considerably increased expense or effort, due to limitations on routing medium channels in the housing 10 or housing 30, to distribute the connecting openings so symmetrically as in FIG. 2.

Figure 3A:
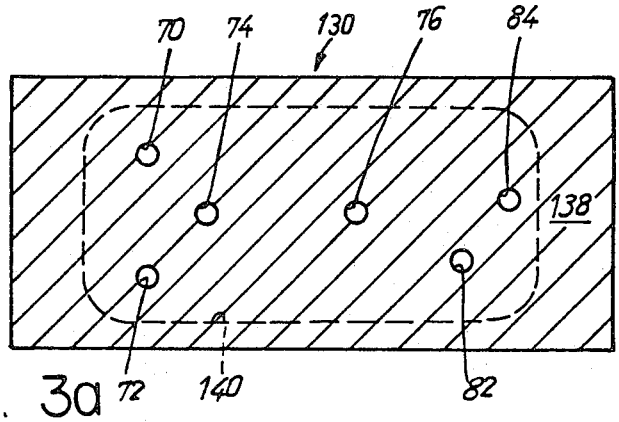
FIGS. 3*a*, 3*b*, and 3*c* are views similar to FIGS. 2*a*–2*c*, wherein, however, all connecting openings for the feed motor of the tape-feed device are offset in the two connecting surfaces of valve block and tape-feed device transversely from the center axis of the sealing plate.
Figure 3B:
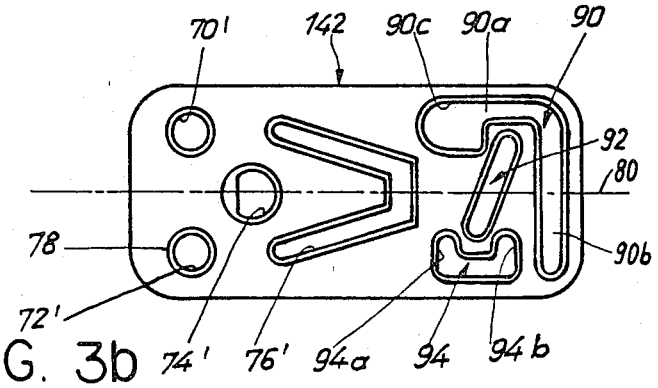
Figure 3C:
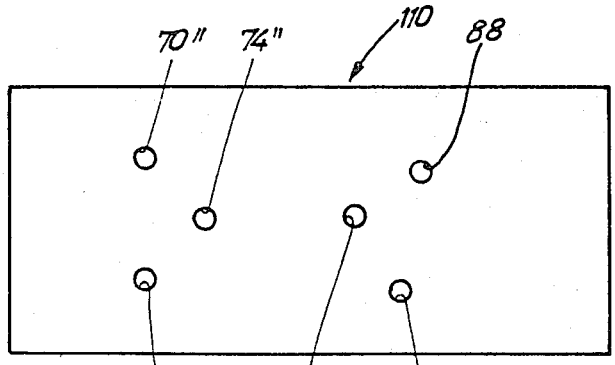

Turning now to FIG. 3, parts which are modified versions of FIG. 2 parts will carry the same reference numerals thereas with 100 added thereto.

The housing 130 of the valve block 8 has connecting openings 70 and 72 and 74 and 76 for the pressure loading of the clamping motors of the clamps 20 and 26. With these correspond openings 70' to 76'' of a modified sealing plate 142 and connecting openings 70'' to 76'' of the housing 110 of the tape-feed device 6. The openings 70' to 76' are again surrounded by sealing beads 78. The connecting openings 70 to 76 and 70'' to 76'' and the openings 70' to 76' are again arranged in pairs in a mirror-image with respect to the plane of symmetry, perpendicular to the drawing plane and containing the longitudinal axis 80 of the sealing plate 142. Accordingly, the pressure load on the clamps 20 and 26 again independent of whether one rotates the sealing plate 142 through 180 degrees about its longitudinal axis 80.

Connecting openings 82 and 84 of the housing 130 (which serve to pressure load the feed motor), like connecting openings 86 and 88 of the housing 110 (which openings are connected to the working chambers of the feed motor) are no longer arranged symmetrically with respect to the plane of symmetry defined by the longitudinal axis 80. In order to be able to connect the connecting opening 82 selectively to the connecting opening 86 or 88 and the connecting opening 84 selectively to the connecting opening 88 or 86, despite this loss of symmetry, three control channels 90, 92 and 94 are provided in the sealing plate 142.

The control channel 90 has two sections 90*a* and 90*b* which are angled with respect to one another and the section 90*a* is enlarged at its end to a large head section 90*c*.

The control channel 92 extends inclined with respect to the longitudinal axis 80, and the control channel 94 has substantially the form of a U with legs 94*a* and 94*b*.

In the first operating position of the sealing plate 142, the end of the leg 94*a* is in alignment with the connecting opening 86, and the end of the leg 94*b* is in alignment with the connecting opening 82. One end (the lower as shown in FIG. 3*b*) of the control channel 92 is in alignment axially with the leg 94*b* and has the same transverse distance from the longitudinal axis 80. Thus, in the second operating position of the sealing plate 142 this one end of the control channel 92 lies at the connecting opening 82, and the second end of the control channel 92 lies above the connecting opening 88.

The section 90*b* of the control channel 90 lies above the connecting opening 84 in both operating positions of the sealing plate 142. The head section 90*c* of the first control channel 90 lies above the connecting opening 88 in the first operating position of the sealing plate 142, and lies above the connecting opening 86 in the second operating position. The axial dimension of the head section 90*c* thus corresponds with the axial distance of the connecting openings 86 and 88, and its transverse dimension corresponds with the difference in transverse distance of the connecting openings 86 and 88 from the longitudinal axis 80.

Therefore, in the first operating position of the sealing plate 142, a pressure-medium connection exists between the connecting opening 84 and the connecting opening 88 through the control channel 90, and between the connecting opening 82 and the connecting opening 86 through the control channel 94, and the control channel 92 is closed off by the connecting surfaces 38 and 44 (shown in FIG. 1).

In the second operating position of the sealing plate 142, a pressure-medium connection exists between the connecting opening 84 and 86 through the control channel 90 and between the connecting opening 82 and the connecting opening 88 through the control channel 92, and the control channel 94 is not in operation.

One recognizes that by providing three control channels in the sealing plate 142 by reversing the sealing plate a movement reversal can be achieved even when the feed-motor connecting openings 82 and 84 and/or 86 and 88 are not arranged symmetrically with respect to the longitudinal axis 80 of the sealing plate 142.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A pressure-medium connection between a valve block and a load which has at least one double-acting pressure-medium motor, including two connecting openings constructed in the valve-block housing for the pressure-medium motor, two connecting openings constructed in the load housing for the pressure-medium motor and including a sealing plate which has openings through which the connecting openings of the valve-block housing can be connected to the connecting openings of the load housing, the improvement comprised wherein (a) the connecting openings of the valve-block housing are offset with respect to the connecting openings of the load housing; and (b) the openings of the sealing plate are constructed as control channels which extend in the plane of the sealing plate, said channels in a first operating position of the sealing plate connecting the first connecting openings of valve-block housing and load housing and the second connecting openings of valve-block housing and load housing and in a second operating position of the sealing plate connected the first connecting opening of the valve block housing to the second connecting opening of the load housing and the second connecting opening of the valve-block housing to the first connecting opening of the load housing.

2. A connection according to claim 1, wherein the sealing plate can be shifted by rotation about one of its main axes between its two operating positions; the connecting openings of one of the valve-block housing and load housing intersecting and being axially spaced along said main axis, the connecting openings of the other of said load housing and valve-block housing being spaced transversely from said main axis; the control channels having respective axial sections which start out from the transversely spaced connecting openings, and having respective transverse sections which each lead to one of the axially spaced connecting openings which are distributed along the main axis.

3. A connection according to claim 2, wherein the transversely spaced connecting openings lie in a common transverse plane with respect to the one main axis.

4. A connection according to claim 1, wherein the connecting openings of valve-block housing and of load housing are all arranged at a transverse distance from a main axis of the sealing plate, the sealing plate being capable of being shifted between its two operating positions by pivoting, wherein the sealing plate has three control channels, the first said control channel in the first operating position connecting the first connecting opening of the valve-block housing to the first connecting opening of the load housing and in the second operating position connecting the first connecting opening of the valve-block housing to the second connecting opening of the load housing, the second said control channel in said first operating position connecting the second connecting opening of the valve-block housing with the second connecting opening of the load housing and does not create a pressure-medium connection in said second operating position, the third said control channel in said first operating position does not create a pressure-medium connection and in said second operating position connects the second connecting opening of the valve-block housing to the first connecting opening of the load housing.

5. A connection according to claim 4, wherein the first ends of the second and third control channels are in a common plane transverse to said one main axis and the second ends of the second and third control channel define together an axial and radial area, over which extends also an enlarged head section of the first control channel.

6. A connection according to claims 1 to 5, wherein the sealing plate has further openings for connection of further connecting openings of valve-block housing and load housing, which connection is independent of the position of the sealing plate.

* * * * *

UNITED STATES PATENT AND TRADEMARK OFFICE

CERTIFICATE OF CORRECTION

PATENT NO. : 4 348 942

DATED : September 14, 1982

INVENTOR(S) : Kurt Stoll

It is certified that error appears in the above—identified patent and that said Letters Patent is hereby corrected as shown below:

Col. 5, lines 56 and 57; change "connected" to ---connecting---

Col. 6, line 52; change "according to claims 1 to 5" to ---according to one of claims 1 to 5---.

Signed and Sealed this

*Twenty-eighth* Day of *December 1982*

[SEAL]

*Attest:*

GERALD J. MOSSINGHOFF

*Attesting Officer*

*Commissioner of Patents and Trademarks*